US007160486B2

(12) United States Patent
Valiere

(10) Patent No.: US 7,160,486 B2
(45) Date of Patent: Jan. 9, 2007

(54) MATERIAL BASED ON VINYLESTER RESIN FOR NEUTRON SHIELDING AND MAINTENANCE OF SUB-CRITICALITY

(75) Inventor: Martine Valiere, Puteaux (FR)

(73) Assignee: Cogema Logistics, Montigny Le Bretonneux (FR)

( * ) Notice: Subject to any disclaimer, the term of this patent is extended or adjusted under 35 U.S.C. 154(b) by 0 days.

(21) Appl. No.: 10/497,267

(22) PCT Filed: Dec. 10, 2002

(86) PCT No.: PCT/FR02/04255

§ 371 (c)(1),
(2), (4) Date: May 27, 2004

(87) PCT Pub. No.: WO03/050822

PCT Pub. Date: Jun. 19, 2003

(65) Prior Publication Data

US 2005/0012054 A1 Jan. 20, 2005

(30) Foreign Application Priority Data

Dec. 12, 2001 (FR) ..... 01 16036

(51) Int. Cl.
*G21F 1/10* (2006.01)

(52) U.S. Cl. ..... 252/478

(58) Field of Classification Search ..... None
See application file for complete search history.

(56) References Cited

U.S. PATENT DOCUMENTS 2,961,415 A * 11/1960 Axelrad ..... 252/478
3,133,887 A * 5/1964 Alliegro et al. ..... 252/478
3,361,684 A * 1/1968 Chvatal ..... 252/478
4,134,937 A * 1/1979 Cass et al. ..... 523/136
6,548,570 B1 * 4/2003 Lange ..... 523/137
6,797,972 B1 * 9/2004 Kamoshida et al. ..... 250/507.1
2005/0001205 A1 * 1/2005 Malalel et al. ..... 252/478

FOREIGN PATENT DOCUMENTS

| | | | |
|---|---|---|---|
| DE | 199 55 192 | A1 | 5/2001 |
| EP | 0 108 622 | A2 | 5/1984 |
| EP | 0 372 758 | A1 | 6/1990 |
| EP | 0 628 968 | A1 | 12/1994 |
| GB | 1049890 | A | 11/1966 |
| JP | 55 119099 | A | 9/1980 |
| JP | 59 126296 | A | 7/1984 |
| WO | WO 95/28440 | A1 | 10/1995 |

OTHER PUBLICATIONS

USPTO obtained translation for JP 55-119099, "Neutron Shielding Material," Sep. 12, 1980.*
"Vinyl Ester Polymers," *Encyclopedia of Polymer Science and Engineering*, John Wiley & Sons, New York, 1989, pp. 393-441.

* cited by examiner

*Primary Examiner*—Matthew A. Thexton
(74) *Attorney, Agent, or Firm*—Christensen O'Connor Johnson Kindness PLLC

(57) ABSTRACT

This invention relates to a composite material for neutron shielding and maintenance of sub-criticality comprising a matrix based on vinylester resin and an inorganic filler capable of slowing and absorbing neutrons.

The vinylester resin may be an epoxymethacrylate resin and the inorganic filler may contain a zinc borate and an alumina hydrate or magnesium hydroxide.

14 Claims, 1 Drawing Sheet

MATERIAL BASED ON VINYLESTER RESIN FOR NEUTRON SHIELDING AND MAINTENANCE OF SUB-CRITICALITY

TECHNICAL DOMAIN

The purpose of this invention is a material for neutron shielding and maintenance of sub-criticality. This type of material is useful in nuclear energy to protect operators from neutron radiation emitted by radioactive products and to prevent runaway of the neutron formation chain reaction, more particularly when these products contain fissile materials.

In particular, they can be used as neutron shielding in transport packagings and/or for the storage of radioactive products, for example nuclear fuel assemblies.

For neutron shielding, neutrons have to be slowed down and therefore materials containing large quantities of hydrogen have to be used, including the addition of a boron compound to capture neutrons.

To maintain sub-criticality, it is necessary to have a high content of neutron absorber such as boron to prevent runaway of the neutron formation chain reaction.

Moreover, these materials must be self-extinguishing.

STATE OF THE PRIOR ART

Neutron shielding materials obtained from a mix of a high-density inorganic material and a thermosetting resin have been described in EP-A-0 628 968 [1]. In this document, the thermosetting resin may be an unsaturated polyester resin and the inorganic fillers may be heavy metals or compounds of heavy metals.

Document GB-A-1 049 890 [2] describes moulded articles or coatings absorbing neutrons containing at least 0.3% by weight of boron obtained from a co-polymerisable mix of an unsaturated polyester and an unsaturated monomer, in which either the acid component of the polyester is derived partly from boric acid, or the polymerisable monomer is partly a boric acid ester.

Document JP-A-55 119099 [3] describes materials providing protection against neutrons also based on unsaturated polyester resin. This type of material has a hydrogen atoms density equal to $6.1\times10^{22}$ atoms of hydrogen per $cm^3$, but it does not contain any neutron absorber. Thus, it cannot keep a nuclear fuel transport packaging sub-critical.

These materials based on unsaturated polyester resin have the disadvantage that they have only a mediocre resistance to thermal aging.

PRESENTATION OF THE INVENTION

The purpose of this invention is specifically a material for neutron shielding and maintenance of sub-criticality that has better resistance to corrosion than materials based on unsaturated polyester.

According to the invention, the composite material for neutron shielding and maintenance of sub-criticality comprises a matrix based on vinylester resin and an inorganic filler capable of slowing and absorbing neutrons.

According to the invention, the vinylester resin may be of different types. In general, the resins used are obtained by the addition of a carboxylic acid onto an epoxy resin.

The epoxy resins used have one of two possible types of macromolecular pattern:

bisphenol A, and novolac.

In particular, the carboxylic acid may be acrylic acid or methacrylic acid. Preferably, methacrylic acid is used.

Thus, the vinylester resin is preferably chosen from the group composed of epoxyacrylate resins, epoxymethacrylate resins, bisphenol A type resins, novolac type resins and halogenated resins based on bisphenol A.

The epoxyacrylate and epoxymethacrylate bisphenol A type resins may comply with the following formula:

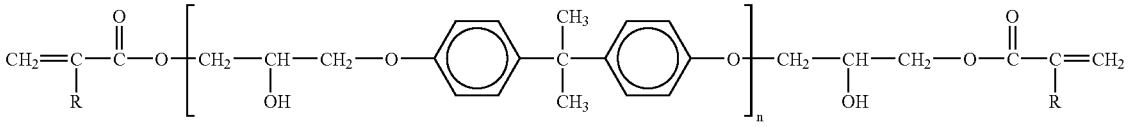

in which R represents H or $CH_3$.

The novolac type vinylester resins may comply with the following formula:

in which R represents H or CH3.

Halogenated vinylester resins based on bisphenol A may also be used according to the invention, for example complying with the following formula:

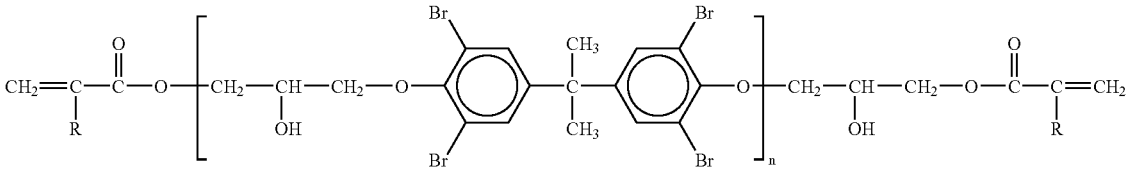

in which R is as defined above.

Non-epoxy vinylester resins may also be used in the invention, obtained from isophthalic polyester and urethane, for example complying with the following formula:

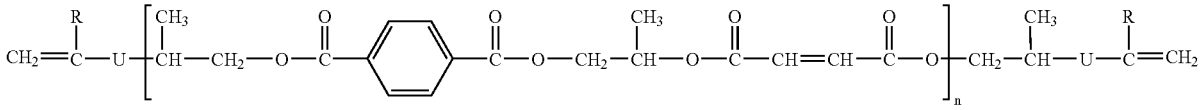

in which R is as defined above and U represents a urethane group.

Due to the choice of these vinylester resins, the composite material according to the invention has the following advantages.

The atomic concentration of hydrogen in vinylester resins is greater than the atomic concentration of unsaturated polyesters, therefore neutron slowing is better.

These resins have excellent thermal stability and a very good resistance to corrosion, which is advantageous for materials used for neutron shielding and maintenance of sub-criticality, for which usage temperatures are often high.

The material is easy to make since the vinylester resin may be poured directly into the mould that will form the transport or storage packaging for radioactive products.

The loss of mass of shielding materials made of these vinylester resins is low at high temperature.

In the material according to the invention, the vinylester resins have been transformed into a thermosetting material by reaction with a copolymerisable monomer such as styrene and styrene derivatives such as methylstyrene and divinylbenzene, vinyltoluene, methyl methacrylate and allylic derivatives such as diallyl phthalate.

According to the invention, the material also comprises an inorganic filler capable of slowing down and absorbing neutrons, for example metals, metal compounds, boron, boron compounds.

According to the invention, this inorganic filler may in particular comprise at least one inorganic compound of boron and at least one hydrogenated inorganic compound. Boron compounds that could be used belong to the group comprising boric acid $H_3BO_3$ , colemanite $Ca_2O_{14}B_6H_{10}$, zinc borates $Zn_2O_{14.5}H_7B_6$, $Zn_4O_8B_2H_2$ and $Zn_2O_{11}B_6$, boron carbide $B_4C$, boron nitride BN and boron oxide $B_2O_3$. Preferably, the composite material according to the invention comprises at least one boron compound chosen from among zinc borate $Zn_2O_{14.5}H_7B_6$ and boron carbide $B_4C$.

The hydrogenated inorganic compounds that could be used belong preferably to the group of alumina hydrates and magnesium hydroxide.

The material according to the invention may also include polyvinyl acetate, to make the material non-shrinking.

This material may also comprise a hydrogenated organic filler such as melamine, to improve its self-extinguishing properties.

According to the invention, it is preferable to choose the inorganic compound of boron and the inorganic hydrogenated compound and their quantities so as to obtain a boron concentration in the material equal to $8\times10^{20}$ to $15\times10^{21}$ of boron atoms per $cm^3$ and a hydrogen concentration of $4\times10^{22}$ to $6\times10^{22}$ atoms per $cm^3$.

In the material according to the invention, the quantities of the different constituents are also chosen to obtain density, self-extinguishing and thermal conductivity characteristics suitable for use in a transport and/or storage packaging for radioactive materials.

In particular, it is necessary to have good resistance to aging at a relatively high temperature, since products put in the packaging may reach a temperature of 170° C.

The material also needs to be fire resistant, which means that it should be self-extinguishing, in other words the fire goes out when the flame is removed; and therefore it does not feed the fire.

According to the invention, this self-extinguishing property is conferred particularly by the presence of hydrogenated and/or borated inorganic compounds, for example alumina hydrate or zinc borate.

Similarly, the material should have a low thermal conductivity, but sufficiently high to evacuate heat from transported elements such as irradiated fuel elements.

Finally, as will be seen later, since this material is obtained by pouring a mix of different constituents and a vinyl thinner, it is important that the quantities of the different constituents should be such that the mix has the property that it can be poured. In general, the viscosity of the mix must not exceed 300 Poises.

As an example of a material composition according to the invention, consider the material containing 25 to 40% by weight of thermosetting vinylester resin, in other words including the vinyl thinner, for example styrene.

Preferably, according to the invention, the density of the material is equal to or greater than 1.6, for example 1.65 to 1.9.

Preferably, the materials according to the invention can resist a minimum usage temperature of 160° C.

The material according to the invention may be prepared by setting a mix of constituents in the vinylester resin in solution in a vinyl thinner.

Thus, another purpose of the invention is a process for preparation of the composite material described above, which includes the following steps:

prepare a mix of vinylester resin in solution in a vinyl thinner with the inorganic filler, add a catalyst and an accelerator for hardening to the mix, degas the mix under a vacuum, pour the resulting mix in a mould, and allow it to set in the mould.

The vinyl thinner may for example be styrene, vinyltoluene, divinylbenzene, methylstyrene, methyl acrylate, methyl methacrylate or an allylic derivative such as diallyl phthalate. Preferably, styrene will be used which can both dissolve the vinylester resin and enable setting by copolymerisation.

The catalysts and accelerators for hardening used are chosen from among compounds normally used for setting of vinylester resins. In particular, catalysts may be organic peroxides, for example:

peroxides derived from ketones, such as methylethylketone peroxide, acetylacetone peroxide, methylisobutylketone peroxide, cyclohexanone peroxide and cumen hydroperoxide;

diacyl peroxides, for example benzoyl peroxide, possibly combined with aromatic tertiary amines such as dimethylaniline, diethylaniline and dimethylparatoluidine; and dialkyl peroxides such as dicumyl peroxide and ditertiobutyl peroxide.

The most frequently used accelerators are divalent cobalt salts such as cobalt napththenate or octoate, and aromatic tertiary amines such as dimethylaniline, dimethylparatoluidine and diethylaniline.

One or more additives such as cross-linking inhibitors, surfactants and non-shrinking agents can also be added to the mix.

Examples of inhibitors that could be used include acetylacetone and tertiobutylcatechol.

The method according to the invention is implemented as follows:

The vinylester resin (prepolymer+vinyl thinner) is mixed at ambient temperature with the accelerator(s) and different inorganic fillers, for example hydrogenated and borated fillers. The percentage of fillers may vary from 60 to 75%. These fillers may also provide fire reaction properties. The assembly is mixed so as to obtain a perfectly homogenous mix. The catalyst is added to the mix last. The homogenous mix is then degassed under a vacuum (less than 0.01 MPa). The viscosity of the mix must not exceed 300 Poises (the mix must be pourable).

After degassing, the mix is poured in the required mould in which it is cross-linked to form an insoluble thermosetting material. The mechanism of the reaction is radicalar and the reaction is highly exothermal. The setting time may vary depending on pouring conditions (temperature, catalyst content, accelerator and inhibitor contents). Thus, the gel time may be adjusted by varying the percentages of catalyst and accelerators. The gel time varies from 20 minutes to 2 hours.

According to the invention, the mould used for setting of the resin may be formed directly by the transport and/or storage packaging for radioactive products. For example, the packaging may comprise peripheral housings in which the mix is poured.

Another purpose of the invention is a transport and/or storage packaging for radioactive products comprising a shield formed from the composite material described above.

Other characteristics and advantages of the invention will become clearer after reading the following description of exemplary embodiments obviously given for illustrative purposes and that are in no way limitative, with reference to the appended drawing.

DETAILED PRESENTATION OF EMBODIMENTS

Figure 1:
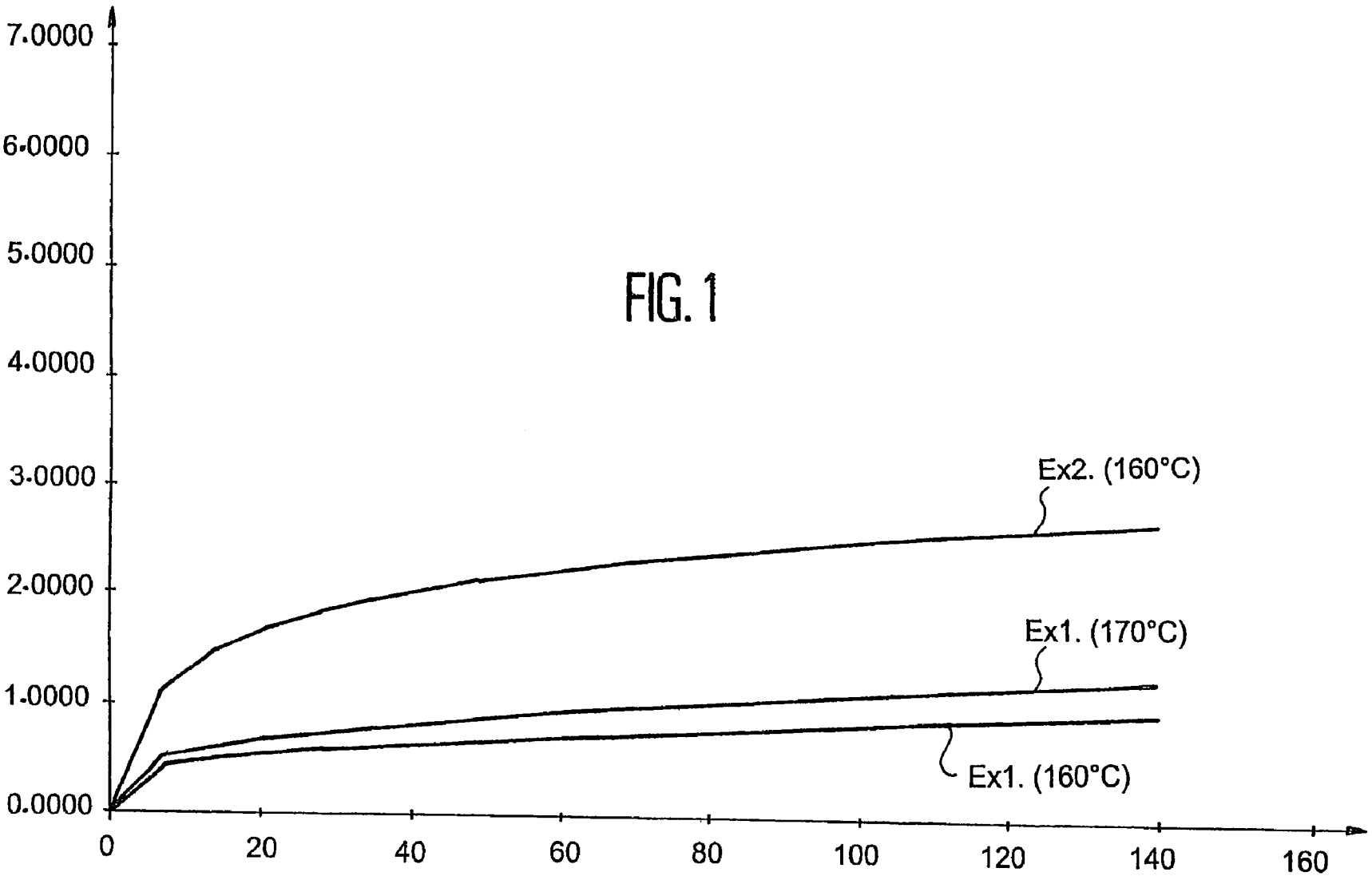
FIG. 1 shows mass losses (in %) at 160 and 170° C. of two materials according to the invention as a function of time (in days).

The following examples illustrate the production of composite materials for neutron shielding and maintenance of sub-criticality, containing zinc borate and alumina hydrate or magnesium hydroxide using the resin marketed by Dow Chemical under the trade name Derakane Momentum 470-300 as the vinylester resin.

EXAMPLE 1

A polymerisable mix is prepared from Derakane Momentum 470-300 vinylester resin, styrene, zinc borate $Zn_2O_{14}$, $_5H_7B_6$ and magnesium hydroxide using the proportions given in table 1 in the appendix.

The following constituents are added to the mix:

1% by weight, relative to the mass of resin+styrene, of the 55028 accelerator marketed by Akzo, and 2% by weight relative to the mass of resin+styrene, of the Butanox M50 catalyst (methylethyl cetone peroxide) marketed by Akzo.

The next step is vacuum degassing of the mix for 3 minutes followed by pouring the mix into a mould composed of a compartment of a nuclear fuel transport or storage packaging.

The gel time is 22 minutes at 20° C.

The result is a composite material with the following properties:

density: 1.697 hydrogen content: 4.72% by weight, namely $4.78\times10^{22}$ atoms/cm$^3$, boron content: 0.97% by weight, namely $9.17\times10^{20}$ atoms/cm$^3$.

The material obtained has satisfactory thermal properties.

The thermal coefficient of expansion $\alpha$ measured by TMA 40 (METTLER) with a temperature rise of 10° C./minute gives the following for the material:

$\alpha$: $35\times10^{-6}$ K$^{-1}$ between 20 and 140° C., and $\alpha$: $97\times10^{-6}$ K$^{-1}$ above 140° C.

The specific heat Cp is measured by differential enthalpic analysis (DSC 30, METTLER) with a temperature rise rate of 10° C./min, for a temperature range varying from 30 to 200° C.

The values of Cp are within the range 1.19 J.g$^{-1}$.° C.$^{-1}$ and 1.89 J.g$^{-1}$.° C.$^{-1}$ for temperatures between 40° C. and 180° C.

Thermal conductivity measurements are also made for temperatures varying from 25° C. to 180° C. Values are included within the range 0.75 and 0.91 W.m$^{-1}$K$^{-1}$.

The mechanical properties of the material are also determined by carrying out compression tests at 23° C. on 10 mm diameter and 20 mm high test pieces, using an Adamel Lhomargy DY26 dynamometer and a test speed of 1 mm/min. The results obtained are as follows:

compression modulus: 4166±100 MPa, ultimate stress: 155.3±0.8 MPa, compression at failure: 7±0.2%.

Considering the high hydrogen content of the material in example 1, it is particularly suitable for a radiation shielding application.

EXAMPLE 2

The same operating method is used as in example 1, using the constituents and proportions given in table 1.

The mix also includes:

0.9% by weight relative to the mass of resin, of the accelerator NL 49P marketed by Akzo, and 1.5% by weight relative to the mass of resin, of the Butanox M50 catalyst marketed by Akzo.

Setting takes place at ambient temperature and after 25 minutes, a material with the following characteristics is obtained:

density: 1.79 hydrogen content: 4.80% by weight, namely $5.14\times10^{22}$ at/cm$^3$, boron content: 0.89% by weight, namely $8.92\times10^{20}$ at/cm3.

The material obtained has satisfactory thermal properties.

The thermal coefficient of expansion a measured by DSC (METTLER) with a temperature rise of 10° C./min gives the following for the material:

α: $37\times10^{-6}$ $K^{-1}$ between 20 and 130° C., and

α: $109\times10^{-6}$ $K^{-1}$ above 130° C.

The specific heat Cp is measured by differential enthalpic analysis (DSC30, METTLER) with a temperature rise rate of 10° C./min for a temperature range varying from 40° C. to 180° C. Values of Cp are within the range 1.07 and 1.65 $J.g^{-1}.°C.^{-1}$.

Thermal conductivity measurements are also made for temperatures varying from 20° C. to 170° C. Within this temperature range, the value of the thermal conductivity of the resin is close to 0.8 W/m.K.

The mechanical properties of the material are also determined by carrying out compression tests at 23° C. The compression modulus of the material can thus be found, and is equal to 4299±276 MPa.

Given the hydrogen content, the material in example 2 is particularly suitable for a radiation shielding application.

Thermal aging tests of the material in examples 1 and 2 are also carried out at 160° C., and on the material in example 1 at 170° C.

Aging tests over 6 months consist in putting samples of the material with dimensions 35×25×95 mm into a drying oven at 160° C. and 170° C. and monitoring the mass loss of these samples with time. Variation curves showing the loss of mass of materials (in %) as a function of time (in days) are shown in FIG. 1.

Tests were also carried out on the fire reaction of materials in examples 1 and 2.

Each half-hour fire test at 800° C. was carried out on two 240 mm diameter and 60 mm high blocks of materials in examples 1 and 2. The flame was in direct contact with the material for the first blocks, whereas the second blocks were protected by a 1 mm thick steel plate.

In both cases, and for both materials, self-extinguishing occurs immediately after the torch is removed.

EXAMPLE 3

The same operating method is used as in example 1 to prepare a material for neutron shielding and maintenance of sub-criticality, from the following mix:

| | |
|---|---|
| Derakane Momentum 470-300 vinylester resin | 32% by weight |
| zinc borate | 13% by weight |
| boron carbide $B_4C$ | 15% by weight |
| alumina hydrate | 40% by weight |

The mix also comprises:

0.9% by weight relative to the mass of resin, of the NL49P accelerator, and 1.5% by weight relative to the mass of resin, of the Butanox M50 catalyst Setting takes place at ambient temperature; a material with the following characteristics is obtained after 25 minutes: .

density: 1.8 hydrogen content: 4.03% by weight, namely $4.34\times10^{22}$ at/$cm^3$, and boron content: 13.68% by weight, namely $1.37\times10^{22}$ at/$cm^3$.

Considering its high boron content, the material in example 3 has excellent efficiency in maintaining sub-criticality.

Thus, the material according to the invention has very attractive properties for neutron shielding and maintenance of sub-criticality for the transport of nuclear fuel assemblies.

REFERENCES MENTIONED

[1] EP-A-0 628 968

[2] GB-A-1 049 890

[3] JP-A-55 119099

TABLE 1

| Constituents | Example 1 (% by weight) | Example 2 (% by weight) | Example 3 (% by weight) |
|---|---|---|---|
| Derakane Momentum 470-300 vinylester resin | 32 | 32 | 32 |
| Added styrene | 5 | | |
| Zinc borate $Zn_2O_{14.5}B_7H_6$ | 6.5 | 6 | 13 |
| Boron carbide $B_4C$ | | | 15 |
| Magnesium hydroxide | 56.5 | | |
| Alumina hydrate | | 62 | 40 |
| Gel time | 22 min | 25 min | 25 min |

The invention claimed is:

1. Composite material for neutron shielding and maintenance of sub-criticality comprising:

(a) a matrix based on vinylester resin comprising at least one compound chosen from the group consisting of epoxyacrylate vinylester resins, epoxymethacrylate vinylester resins, bisphenol A type vinylester resins, novolac type vinylester resins, halogenated vinylester resins based on bisphenol A, and vinylester resins obtained from isophthalic polyester and urethane; and (b) an inorganic filler capable of slowing and absorbing neutrons, the inorganic filler comprising at least one inorganic compound of boron and at least one hydrogenated inorganic compound.

2. Material according to claim 1 in which the vinylester resin is an epoxy(meth)acrylate bisphenol A type resin complying with the following formula:

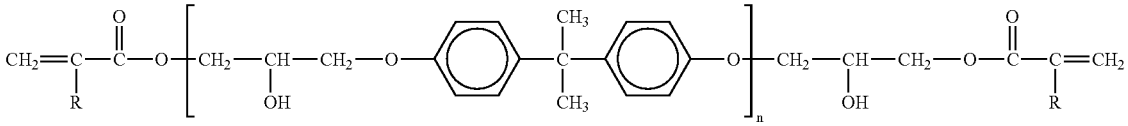

in which R represents H or $CH_3$.

3. Material according to claim 1 in which the vinylester resin is a novolac resin of formula:

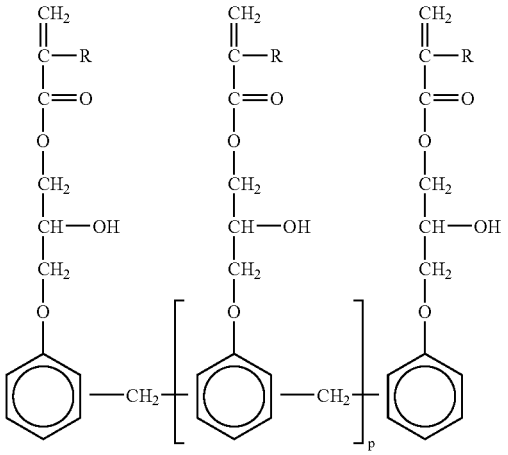

in which R represents H or $CH_3$.

4. Material according to claim 1 in which the inorganic compound of boron is chosen from the group consisting of boric acid $H_3BO_3$, zinc borates $Zn_2O_{14.5}H_7B_6$, $Zn_4O_8B_2H_2$ and $Zn_2O_{14}B_6$, colemanite $Ca_2O_{14}B_6H_{10}$, boron carbide $B_4C$, boron nitride BN and boron oxide $B_2O_3$.

5. Material according to claim 1 comprising at least one boron compound chosen among the group consisting of zinc borate $Zn_2O_{14.5}H_7B_6$, and born carbide $B_4C$.

6. Material according to claim 1 in which the hydrogenated inorganic compound is chosen from the group consisting of alumina hydrates and magnesium hydroxide.

7. Material according to claim 1 in which the quantities of inorganic hydrogenated compound and inorganic compound of boron are such that the boron concentration in the material is equal to $8\times10^{22}$ to $15\times10^{21}$ of boron atoms per $cm^3$ and that the hydrogen concentration is $4\times10^{22}$ to $6\times10^{22}$ atoms per $cm^3$.

8. Material according to claim 1, comprising 25 to 40% by weight of vinylester resin.

9. Material according to claim 1, with a density equal to or greater than 1.6, preferably 1.65 to 1.9.

10. Material according to claim 1, which can resist a minimum usage temperature of 160° C.

11. Process for preparation of a composite material according to claim 1, including the following steps:

prepare a mix of vinylester resin in solution in a vinyl thinner with the inorganic filler, add a catalyst and an accelerator for hardening to the mix, degas the mix under a vacuum, pour the resulting mix in a mould, and allow the resulting mix to set in the mould.

12. Process according to claim 11, in which the vinyl thinner is styrene.

13. Process according to claim 11, in which the mould is a transport and/or storage packaging for radioactive products.

14. Transport and/or storage packaging for radioactive products comprising a shield formed from a composite material according to claim 1.

* * * * *

UNITED STATES PATENT AND TRADEMARK OFFICE

CERTIFICATE OF CORRECTION

PATENT NO. : 7,160,486 B2
APPLICATION NO. : 10/497267
DATED : January 9, 2007
INVENTOR(S) : M. Valiere It is certified that error appears in the above-identified patent and that said Letters Patent is hereby corrected as shown below:

| COLUMN | LINE | ERROR |
|---|---|---|
| 9 (Claim 4, | 26 line 4) | "$Zn_2O_{14}B_6$, " should read --$Zn_2O_{11}B_6$,-- |
| 9 (Claim 5, | 28 line 1) | after "claim 1" insert --,-- |
| 9 (Claim 5, | 30 line 3) | "born carbide" should read --boron carbide-- |
| 9 (Claim 6, | 31 line 1) | after "claim 1" insert --,-- |
| 10 (Claim 9, | 1 line 1) | after "claim 1" insert --,-- |
| 10 (Claim 7, | 4 line 4) | "$8x10^{22}$" should read --$8x10^{20}$-- |

Signed and Sealed this

Fifteenth Day of May, 2007

JON W. DUDAS
*Director of the United States Patent and Trademark Office*